US005512987A

United States Patent [19]

Miller et al.

[11] Patent Number: 5,512,987

[45] Date of Patent: Apr. 30, 1996

[54] SEALING STRIP ADHERING METHOD

[75] Inventors: Daniel C. Miller, Fairport; Carlton W. Campbell, Webster, both of N.Y.

[73] Assignee: Xerox Corporation, Stamford, Conn.

[21] Appl. No.: 248,781

[22] Filed: May 25, 1994

[51] Int. Cl.[6] ..... G03G 15/06

[52] U.S. Cl. ..... 355/260; 355/200

[58] Field of Search ..... 355/200, 210, 355/245, 260, 77; 222/DIG. 1; 118/653; 156/60, 69

[56] References Cited

U.S. PATENT DOCUMENTS

| | | | |
|---|---|---|---|
| 4,065,335 | 12/1977 | Pollack | 156/69 |
| 4,142,655 | 3/1979 | Fantuzzo | 222/318 |
| 4,478,512 | 10/1984 | Zoltner . | |
| 4,599,851 | 7/1986 | Williams | 53/471 |
| 4,827,307 | 5/1989 | Zoltner . | |
| 4,895,104 | 1/1990 | Yoshino et al. | 118/653 |
| 5,040,025 | 8/1991 | Fukuchi | 355/260 |
| 5,134,441 | 7/1992 | Nagata et al. | 355/245 |
| 5,142,335 | 8/1992 | Sakata et al. | 355/260 |
| 5,207,353 | 5/1993 | Corby et al. | 222/1 |
| 5,267,003 | 11/1993 | Grappiolo | 355/260 |
| 5,335,831 | 8/1994 | Foster | 222/DIG. 1 X |
| 5,370,761 | 12/1994 | Chitouras | 222/DIG. 1 X |

OTHER PUBLICATIONS

Product Data Sheet form Oliver Products Company titled "18B/1073 B Tyvek® Toner Seal Material".

*Primary Examiner*—Sandra L. Brase
*Attorney, Agent, or Firm*—Zosan S. Soong

[57] ABSTRACT

A method which includes: (a) selecting a flexible strip which has an adhesive material on a part of the first side, thereby defining an adhesive coated portion on the first side, and the second side of the strip being free of any adhesive material; and (b) applying heat and pressure to the adhesive coated portion on the first side, by pressing a heating element directly against the adhesive coated portion on the first side, to adhere a part of the adhesive free second side to a strip attachment region on a member, wherein there is absent any adhesive material disposed between the adhered part of the adhesive free second side and the strip attachment region.

6 Claims, 3 Drawing Sheets

SEALING STRIP ADHERING METHOD

This invention relates generally to a method for attaching a flexible sealing strip to a container. More specifically, the invention relates to a method for adhering a flexible sealing strip to the housing of a toner cartridge or to a strip unsealing apparatus of a toner cartridge without the use of adhesive material.

To attach a sealing strip to a component of a toner cartridge such as the housing, double sided adhesive tape, single sided adhesive tape (wherein the ends are joined and the adhesive side faces outwards), and hot melt or other adhesives may be employed between the joined surfaces of the strip and the toner cartridge housing. Single sided adhesive tape may also be employed to simply tape a portion of the strip to the toner cartridge housing.

There is a need for a strip attachment method which minimizes or eliminates the use of adhesive materials whether applied to the sealing strip, the container surface, both the sealing strip and the container surface, or used in the form of adhesive tape.

Toner cartridges and/or sealing strips are illustrated by the following: Zoltner, U.S. Pat. No. 4,827,307; Williams, U.S. Pat. No. 4,599,851; Nagata et al., U.S. Pat. No. 5,134,441; Fantuzzo, U.S. Pat. No. 4,142,655; Zoltner, U.S. Pat. No. 4,478,512; Corby et al., U.S. Pat. No. 5,207,353; and Product Data sheet from Oliver Products Company titled "18B/1073B TYVEK® TONER SEAL MATERIAL," the disclosures of which are entirely incorporated by reference.

SUMMARY OF THE INVENTION

It is an object of the invention to provide a strip attachment method which minimizes or eliminates the use of adhesive materials whether applied to the sealing strip, the container surface, both the sealing strip and the container surface, or used in the form of adhesive tape.

It is a further object in embodiments of the instant invention to provide a sealing strip adhering method which may result in material cost savings and a savings in assembly costs, and which is simplier as compared with conventional methods.

These objects and others are accomplished in embodiments by providing a method comprising applying heat on a first portion of a flexible strip to adhere the first portion to a surface in the absence of an adhesive material disposed between the first portion and the surface.

There is further provided in embodiments of the instant invention an apparatus for storing a supply of marking particles therein comprising:

(a) a container defining a chamber for storing the marking particles therein and having a surface defining an opening in communication with the chamber, wherein the surface further defines a first strip attachment region surrounding the opening;

(b) a second strip attachment region defined on the surface of the container or defined on a surface of an optional strip unsealing apparatus associated with the container; and (c) a flexible strip having a first side and a second side, wherein a portion of the first side covers the opening and is removably adhered to the first strip attachment region, thereby sealing the opening to prevent the discharge of the marking particles, and a portion of the second side is heat adhered to the second strip attachment region wherein there is absent any adhesive material disposed between the portion of the second side and the second strip attachment region.

As used herein, the phrases "adhering," "adhesion," "adhere," and "adhered" refer to two surfaces which are bonded together in the attachment region. Adhered surfaces may result from for example the use of adhesive material (an adhesive on one or both surfaces, two sided tape, and the like) between the surfaces. Adhered surfaces may also result from the melting of one or both surfaces to bond to one another upon application of heat and pressure as disclosed herein wherein the surfaces are devoid of adhesive material. Two surfaces which are fastened to one another by an external source where there is no adhesive material between the surfaces are not considered "adhered" surfaces for the purposes of the instant invention. An example where two surfaces, fastened by an external source, are not considered "adhered" surfaces involves single sided adhesive tape that is employed to tape the strip to the toner cartridge housing wherein no adhesive material is present between the surface of the toner cartridge housing and the strip side facing the housing (the adhesive coated side of the tape contacts the side of the strip which faces away from the housing surface).

As used herein, the phrase adhesive material includes glue, hot melt adhesive, adhesive tape, and the like.

BRIEF DESCRIPTION OF THE DRAWINGS

Other aspects of the present invention will become apparent as the following description proceeds and upon reference to FIGS. 1–4 which represent preferred embodiments and are substantially to scale.

Unless otherwise noted, the same reference numeral in the Figures refers to the same or similar feature.

DETAILED DESCRIPTION

Figure 1:
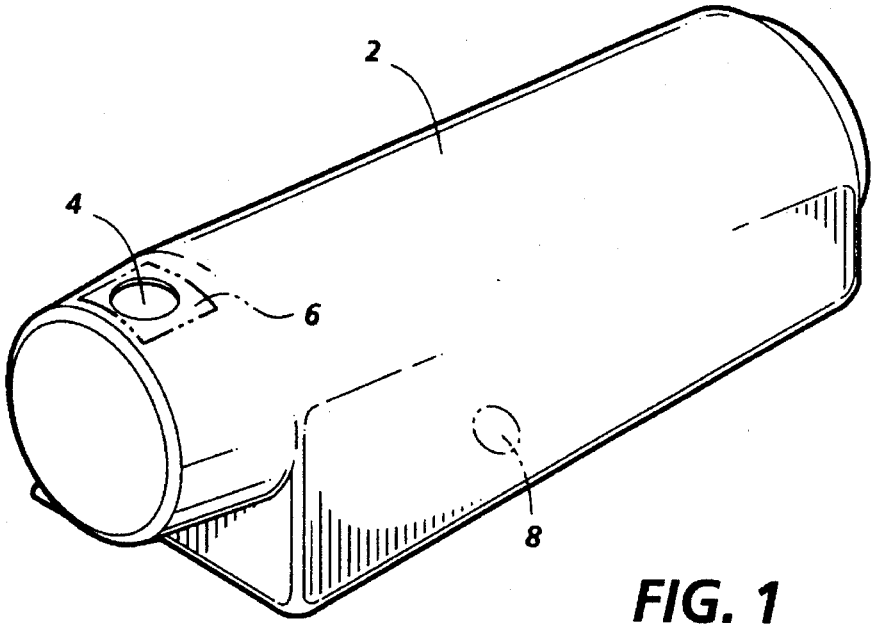
FIG. 1 is a perspective, schematic view of a container for storing a supply of marking particles.

In FIG. 1, container 2 has an opening 4 adjacent an end of the container. The container 2 may be a housing of a toner cartridge and thus the opening 4 may permit the flow of marking particles like toner or developer to replenish the supply of the marking particles within an electrostatographic printing or copying device. The container 2 comprises a chamber (not shown) for storing the marking particles. The container 2 has a first strip attachment region 6 encompassing the opening 4 and a second strip attachment region 8. The first strip attachment region 6 may be a curved portion of the container surface and the second strip attachment region 8 may be a flat portion of the container surface.

Figure 2:
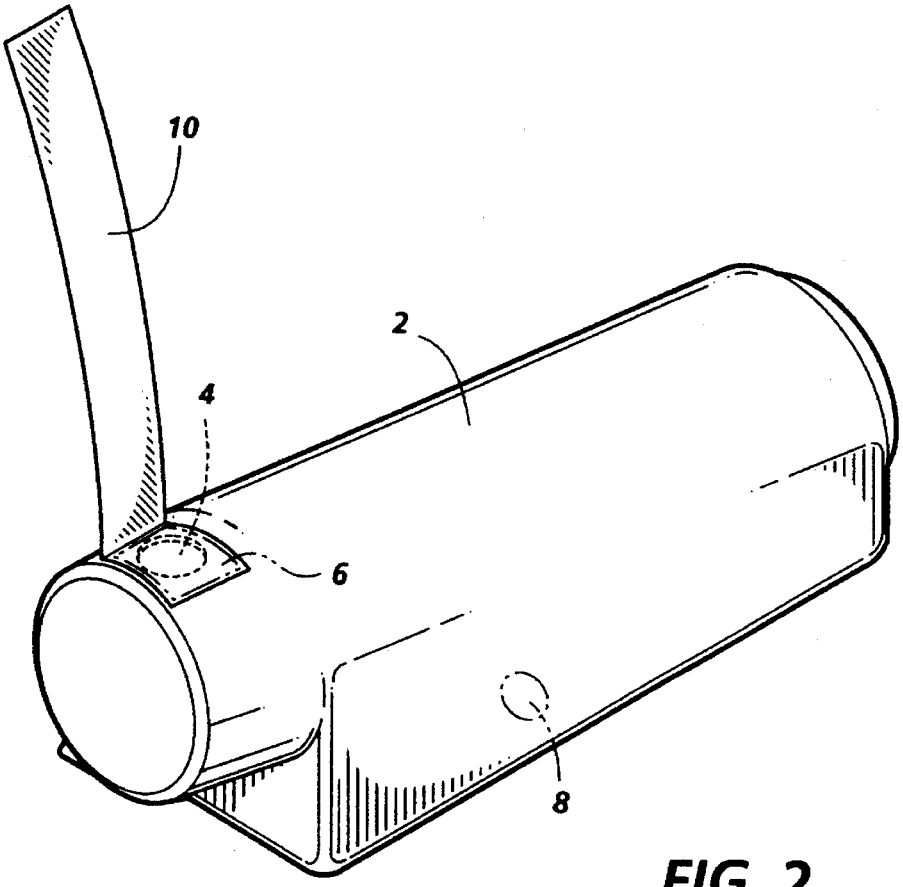
FIG. 2 is a perspective, schematic view of the container and a flexible sealing strip wherein one end of the strip is attached to the container.

In FIG. 2, a flexible strip 10 is used to seal the opening 4. One side of the strip 10 may be entirely bare of adhesive material and the other side of the strip may be entirely coated with a layer of for instance a hot melt heat sealable adhesive. In FIG. 2, an end of the strip 10: adhesive side adjacent the container surface, is attached by for example heat sealing to the first strip attachment region 6. Application of heat melts the hot melt heat sealable adhesive, thereby resulting in adhesion of the strip to the first strip attachment region 6 of the container, wherein adhesive material is disposed between the strip 10 and the first strip attachment region 6. The strip 10 covers the opening 4 and adheres to the region of the container surface extending up to for example from about 3 mm to about 15 mm beyond the edge of the opening 4.

Heat sealing of the adhesive coated side to the container surface may be accomplished by any effective apparatus and method. For example, a solid metal heating element with a coupled silicone elastomer pad having a thickness of about 15 mm may be employed. Both the heating element and the silicone pad may be flat or curved to match the curvative of the first strip attachment region. The heating element and the pad are pressed against the portion of the adhesive free side, which is directly above the adhesive coated side portion to be attached to the container, at any effective time, pressure, and temperature: the heating element may have a temperature ranging for instance from about 330° to about 350° F., and preferably about 340° F.; the heating element and the pad may be pressed against the container surface at a pressure ranging for instance from about 50 to about 70 psi, and preferably about 60 psi (as determined by a compressed air gauge of a pneumatic device for moving the heating element and the pad); and the heating element and pad may be pressed against the strip for a time ranging for instance from about 2 to about 4 seconds, and preferably about 2.5 seconds.

In an alternate embodiment, both sides of the strip are free of adhesive material and a predetermined portion of the strip is heat sealed to the first strip attachment region in a manner similar to the attachment of the strip to the second strip attachment region as disclosed herein. Thus, in this alternate embodiment, a portion of the strip, such as an end portion, adheres to the first strip attachment region of the container in the absence of an adhesive material disposed between the strip portion and the first strip attachment region.

Figure 3:
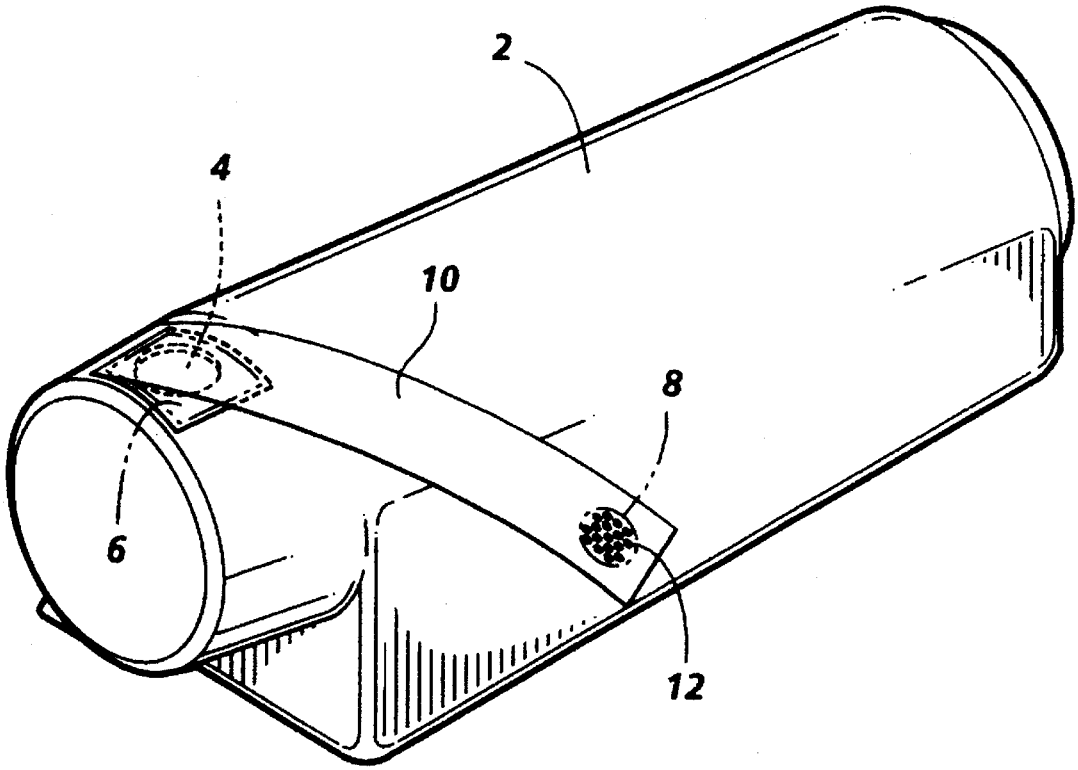
FIG. 3 is a perspective, schematic view of the container and a flexible sealing strip wherein each end of the strip is attached to the container.

In FIG. 3, the strip 10 is folded over and the other end of the strip, adhesive free strip side adjacent the container surface, is attached by for example heat sealing to the second strip attachment region 8. A strip portion ranging in width for example from about 4 mm to about 15 mm may adhere to the second strip attachment region 8 of the container 2. During the heat sealing, a heating element presses a predetermined portion of the strip against the container surface and the applied heat may melt a portion of the strip including a part of the adhesive free side and/or a portion of the container surface; the melting, mixing, and subsequent ambient cooling of the adhesive free side and the container surface enhance adhesion between the two surfaces. In embodiments of the instant invention, the strip is heated to a temperature (the temperature of the strip during the heat sealing process is assumed for simplicity to be the same as the temperature of the heating element) equal to or above the melting temperature of the strip and/or the container, wherein preferred temperatures are as disclosed herein.

Heat sealing a portion of the adhesive free side of the strip to the container surface may be accomplished by any effective apparatus and method. For example, a solid metal heating element having no silicone elastomer pad may be employed. Preferably the heating element has an end which has a discontinuous pattern such as plurality of raised dots and/or diamonds, which may ensure more consistent adhesion results than if the heating element were to have a smooth surface. The number and size of the dots and/or diamonds can be tailored depending on the strength of the adhesion required. The discontinuous pattern on the end of the heating element may produce corresponding holes 12 on the surface of the strip. The heating element is pressed against the portion of the adhesive coated side of the strip, which is directly above the adhesive free side portion to be attached to the container, at any effective time, pressure, and temperature: the heating element may have a temperature ranging for instance from about 310° to about 330° F., and preferably about 320° F.; the heating element may be pressed against the container surface at a pressure ranging for instance from about 30 to about 50 psi, and preferably about 40 psi (as determined by a compressed air gauge of a pneumatic device for moving the heating element); and the heating element may be pressed against the strip for a time ranging for instance from about 1 to about 2 seconds, and preferably about 1.5 seconds.

Figure 4:
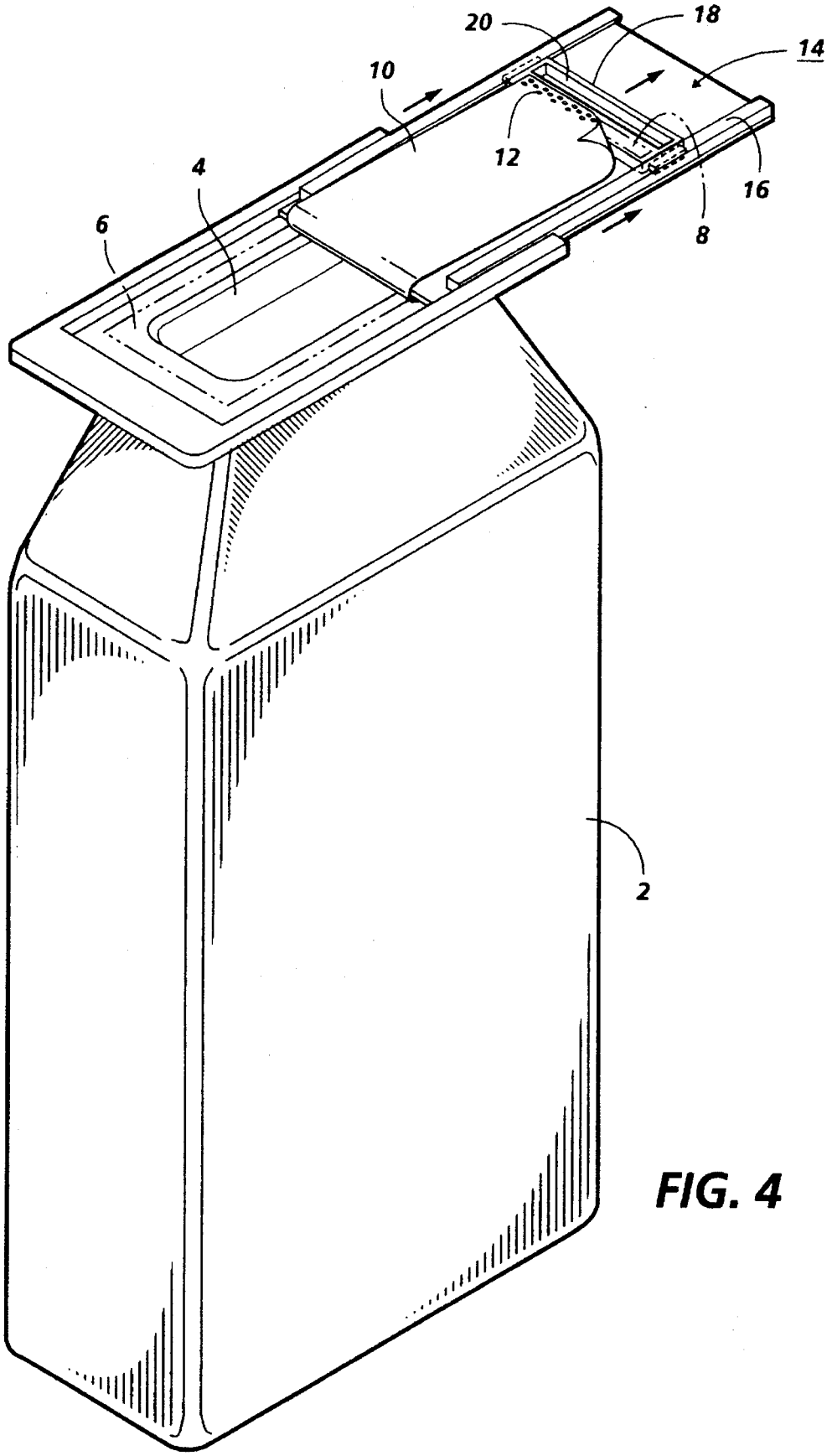
FIG. 4 is a perspective, schematic view of a toner cartridge assembly comprised of a sealing strip and a strip unsealing apparatus.

FIG. 4 discloses an alternative toner cartridge assembly wherein the sealing strip 10 is shown partially unsealed. In FIG. 4, container 2 defines the opening 4 which is in communication with a chamber (not shown) for storing toner and/or developer particles. One side of the strip 10 may be entirely bare of adhesive material and the other side of the strip may be entirely coated with a layer of for example a hot melt heat sealable adhesive. The first strip attachment region 6 surrounds the opening 4 and the edges of strip 10 (adhesive side facing the container surface) are attached by for example heat sealing to the first strip attachment region 6 to seal the opening 4. Application of heat melts the hot melt heat sealable adhesive, thereby resulting in adhesion of the strip to the first strip attachment region 6, wherein adhesive material is disposed between the strip 10 and the first strip attachment region 6. Heat sealing of the adhesive coated side to the container surface may be accomplished by any effective apparatus and method including the technique, apparatus, and conditions disclosed herein for the adhering of the adhesive coated side to the container surface for the embodiment described in FIGS. 1–3.

In FIG. 4, strip unsealing apparatus 14, comprised of a cover plate 16 and an unsealing member 18, engages the top of container 2. The two side edges of cover plate 16 are slidably engaged with the top of container 2 in a tongue and groove arrangement. The two side edges of unsealing member 18 are slidably engaged with the top of cover plate 16 in a tongue and groove arrangment. The unsealing member 18 defines a second strip attachment region 8 on a portion of its top surface and a finger hole 20. An end portion of strip 10 is folded over and a portion of the adhesive free side of the strip is attached by for example heat sealing to the second strip attachment region 8. Heat sealing a portion of the adhesive free side of the strip to the surface of the unsealing member 18 may be accomplished by any effective apparatus and method including the technique, apparatus, and conditions disclosed herein for the adhering of the adhesive free side to the container surface for the embodiment described in FIGS. 1–3. The raised dots on the end of the heating element may produce corresponding holes 12 on the surface of the strip.

In an alternate embodiment of FIG. 4, both sides of the strip 10 are free of adhesive material and the edges of the strip are heat sealed to the first strip attachment region 6 in a manner similar to the attachment of the strip to the second strip attachment region 8 as disclosed herein. Thus, in this alternate embodiment, the edges of the strip adhere to the first strip attachment region 6 of the container in the absence of an adhesive material disposed between the strip and the first strip attachment region 6.

To remove the strip 10 in the embodiment of FIG. 4, an operator places his fingers in the finger hole 20 and slides the unsealing member 18 towards the open end of the cover plate 16. Alternatively, the strip unsealing apparatus 14 may engage an opening mechanism, wherein a suitable protuberance engages the hole 20 and a manual or motorized mechanism slides the unsealing member 18 towards the open end of the cover plate 16. Movement of the unsealing member 18 urges the strip against the end edge of cover plate 16, thereby unsealing the strip and moving the cover plate in the direction of separation.

The strip 10 may removably adhere to the first strip attachment region 6 and to the second strip attachment region 8 at any suitable peel force ranging for example from about 2 to about 4 KgForce (as determined by peeling off the strip from the container at an angle of 90° between the strip and container surface). Preferably, the strip may be peeled from the container surface with minimal or no residual material sticking to the container surface.

The container 2, cover plate 16, and the unsealing member 18 may be fabricated from any suitable material such as a plastic including polyolefins like polyethylene and polypropylene.

The strip is comprised of a flexible substrate film fabricated from for example a polyolefin like polyethylene or polypropylene. The substrate film is available from E.I. DuPont under the tradename TYVEK® which is believed to be a polyethylene. In embodiments, the strip further comprises on one side along a portion or along the entire length thereof an adhesive material, preferably a hot melt heat sealable adhesive, in a layer having a thickness ranging for example from about 0.1 to about 0.5 mm. Flexible strips having a hot melt heat sealable adhesive material on one side are available from Oliver Products Company under the designation "18B/1073B" and other designations. The strip is preferably rectangularly shaped and may have any suitable dimensions. The strip may be of any shape, preferably rectangular, and may have the following illustrative dimensions: a length ranging for example from about 5 to about 15 cm, preferably from about 7 to about 10 cm; a width ranging for example from about 2 to about 7 cm, preferably from about 3 to about 5 cm; and a thickness ranging for example from about 0.5 to about 3 mm, preferably from about 0.8 to about 1.5 mm.

Other modifications of the present invention may occur to those skilled in the art based upon a reading of the present disclosure and these modifications are intended to be included within the scope of the present invention.

We claim:

1. A method comprising:

(a) selecting a flexible strip which has an adhesive material on a part of the first side, thereby defining an adhesive coated portion on the first side, and the second side of the strip being free of any adhesive material; and (b) applying heat and pressure to the adhesive coated portion on the first side, by pressing a heating element directly against the adhesive coated portion on the first side, to adhere a part of the adhesive free second side to a strip attachment region on a member, wherein there is absent any adhesive material disposed between the adhered part of the adhesive free second side and the strip attachment region.

2. The method of claim 1, wherein (b) removably adheres the adhesive free second side to the strip attachment region.

3. The method of claim 1, wherein (b) comprises heating the adhesive free second side to a temperature equal to or above the melting temperature of the strip.

4. The method of claim 1, further comprising adhering a part of the adhesive coated portion on the first side to a different strip attachment region on the member.

5. The method of claim 1, wherein the adhesive material coats the entire first side.

6. The method of claim 1, further comprising adhering a part of the adhesive coated portion on the first side to a different member.

* * * * *